US008585166B2

(12) United States Patent
Chen et al.

(10) Patent No.: US 8,585,166 B2
(45) Date of Patent: Nov. 19, 2013

(54) SLIDE ASSEMBLY AND CONNECTION DEVICE

(75) Inventors: Ken-Ching Chen, Kaohsiung (TW); Chien-Li Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 308 days.

(21) Appl. No.: 13/182,477

(22) Filed: Jul. 14, 2011

(65) Prior Publication Data

US 2013/0016928 A1 Jan. 17, 2013

(51) Int. Cl.
*A47B 88/04* (2006.01)

(52) U.S. Cl.
USPC ..... 312/334.46; 312/333

(58) Field of Classification Search
USPC ..... 312/330.1, 333, 334.1, 334.7, 334.8, 312/334.11, 334.44, 334.46, 334.47; 384/18, 21, 22
See application file for complete search history.

(56) References Cited

U.S. PATENT DOCUMENTS

| | | | | |
|---|---|---|---|---|
| 4,998,828 | A * | 3/1991 | Hobbs | 384/18 |
| 6,373,707 | B1 * | 4/2002 | Hutchins | 361/725 |
| 6,464,311 | B2 | 10/2002 | Liang et al. | |
| 6,997,529 | B1 | 2/2006 | Chen et al. | |
| 7,118,277 | B2 * | 10/2006 | Chen et al. | 384/21 |
| 7,357,468 | B2 | 4/2008 | Hwang et al. | |
| 7,413,269 | B2 | 8/2008 | Chen et al. | |
| 7,520,577 | B2 * | 4/2009 | Chen et al. | 312/334.46 |

* cited by examiner

*Primary Examiner* — James O Hansen
(74) *Attorney, Agent, or Firm* — Rosenberg, Klein & Lee

(57) ABSTRACT

A slide assembly and a connection device include an outer rail, a middle rail slidably connected to the outer rail, and an inner rail slidably connected to the middle rail. The middle rail has a locking member and a synchronizing member extends from the locking member. A releasing member is fixed to the inner rail and a connection member extends from the releasing member. The middle and inner rails are synchronously pulled from the outer rail and when the middle rail is positioned at a desired position, the inner rail is continuously pulled out by the connection between the locking member and the outer rail and by the connection member disengaged from the synchronizing member. When the inner rail is retracted relative to the middle rail, the releasing member releases the middle rail from the outer rail and the middle rail is retracted relative to the outer rail.

7 Claims, 5 Drawing Sheets

SLIDE ASSEMBLY AND CONNECTION DEVICE

FIELD OF THE INVENTION

The present invention relates to a slide assembly and a connection device of the slide assembly, and more particularly, to a three-stage slide assembly and the connection device for positioning the middle rail and the outer rail, and the middle rail synchronously moved with the inner rail.

BACKGROUND OF THE INVENTION

U.S. Pat. No. 6,464,311 discloses a "Lock and release mechanism for slide assembly" and U.S. Pat. No. 7,357,468 discloses a "Locating structure for a slide assembly".

U.S. Pat. No. 6,997,529 discloses a "Synchronizing device for a tri-section slide" and U.S. Pat. No. 7,413,269 discloses a "Synchronous system for a three-stage ball bearing slide".

These locking and synchronizing mechanisms mentioned above are characterized in the engagement between the engaging block and the engaging hole or engaging recess, so that the rails are smoothly moved and synchronized, and the disengagement between the engaging block and the engaging hole or engaging recess to smoothly slide the rails relative to each other.

Furthermore, the locking mechanism and the synchronizing mechanism are individually installed and which require more machining steps and the manufacturing cost is high.

The present invention intends to provide a slide assembly and a connection device of the slide assembly, wherein when the slide assembly is pulled out from its closed position, the inner and middle rails are synchronously pulled out and the middle rail is connected to the outer rail at a proper position where the inner rail and the middle rail are disengaged from each other and the inner rail is pulled continuously. The present invention further connects the synchronizing mechanism between the middle and inner rails and the positioning mechanism between the middle rail and the outer rail.

SUMMARY OF THE INVENTION

The present invention relates to a slide assembly and comprises an outer rail having a locking hole and a releasing hole. A middle rail is slidably connected to the outer rail and has a first hole and a second hole defined therein. When the first hole is located corresponding to the locking hole, the second hole is located corresponding to the releasing hole. A locking member has a fixing portion extending therefrom which is fixed to the middle rail. The locking member has a locking portion and a releasing portion. The locking portion extends through the first hole of the middle rail and resiliently contacts the outer rail. The releasing portion is connected to the locking portion and protrudes from the first hole of the middle rail. A synchronizing member extends from the fixing portion of the locking member and extends through the second hole of the middle rail and resiliently contacts the outer rail. The synchronizing member has a protrusion and a contact portion. The protrusion projects from the second hole of the middle rail and the contact portion is located adjacent to the protrusion. The protrusion has an inclined surface. An inner rail is slidably connected to the middle rail and has a connection hole which has a lug extending therefrom. A releasing member is fixed to the inner rail and has a guide surface which is located corresponding to the releasing portion of the locking member. A connection member extends from the releasing member and has an end portion and a shoulder portion. The end portion is located corresponding to the connection hole of the inner rail and contacting the lug. The shoulder portion extends from the end portion and is located corresponding to the protrusion of the synchronizing member.

When the middle rail slides relative to the outer rail, the locking portion of the locking member slidably contacts the outer rail and is moved in the first hole of the middle rail and to a position corresponding to the locking hole of the outer rail, the locking portion of the locking member is inserted into the locking hole of the outer rail, so that the middle rail is locked relative to the outer rail.

When the inner rail is retracted relative to the middle rail, the releasing portion of the locking member is supported by the guide surface of the releasing member, so that the locking portion of the locking member is disengaged from the locking hole of the outer rail, and the middle rail is retracted relative to the outer rail.

When the inner rail is pulled relative to the outer rail, the shoulder portion of the connection member is engaged with the protrusion of the synchronizing member, so that the middle rail is synchronously pulled with the inner rail. The contact portion of the synchronizing member sinks toward the releasing hole of the outer rail when the middle rail is locked relative to the outer rail. The protrusion is retracted from the second hole, the shoulder portion of the connection member is disengaged from the protrusion of the synchronizing member, so that the inner rail is continuously pulled.

When the middle rail is first retracted relative to the outer rail and the inner rail is then moved relative to the middle rail, the connection member slidably contacts the inclined surface of the protrusion of the synchronizing member. The connection member is resiliently deformed and extends to the connection hole of the inner rail. When the shoulder portion of the connection member slidably contacts and moves over the inclined surface of the protrusion, the connection member releases resilient force to engage the shoulder portion with the protrusion of the synchronizing member.

Preferably, the outer rail has a middle section which extends toward the middle rail so that the locking portion of the locking member and the contact portion of the synchronizing member contact the middle section.

Preferably, the width of the contact portion of the synchronizing member is wider than the width of the locking hole of the outer rail.

Preferably, the width of the synchronizing member is wider than the width of the locking hole of the outer rail.

The present invention also provides a connection device of a slide assembly and comprises a locking member having a fixing portion, a locking portion and a releasing portion. The releasing portion is connected to the locking portion and protrudes from the locking portion. A releasing member has a guide surface located corresponding to the releasing portion of the locking member and the guide surface of the releasing member faces the releasing portion of the locking member and supports the releasing portion of the locking member so as to deform the locking member and move the locking portion. A synchronizing member has a protrusion and a contact portion which is located adjacent to the protrusion. The protrusion has an inclined surface. A connection member has an end portion and a shoulder portion which extends from the end portion. The shoulder portion is located corresponding to the protrusion of the synchronizing member.

When the shoulder portion of the connection member is engaged with the protrusion of the synchronizing member to synchronously move the synchronizing member, and the locking portion of the locking member is positioned, the contact portion of the synchronizing member moves in opposite direction relative to the connection member so as to disengage the protrusion of the synchronizing member from the shoulder portion of the connection member.

When the connection member is moved towards the synchronizing member, the connection member slidably contacts the inclined surface of the protrusion. The connection member is resiliently deformed when the shoulder portion of the connection member slidably contacts and moves over the inclined surface of the protrusion. The shoulder portion of the connection member is engaged with the protrusion of the synchronizing member.

Preferably, the synchronizing member extends from the fixing portion of the locking member.

Preferably, the connection member extends from the releasing member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
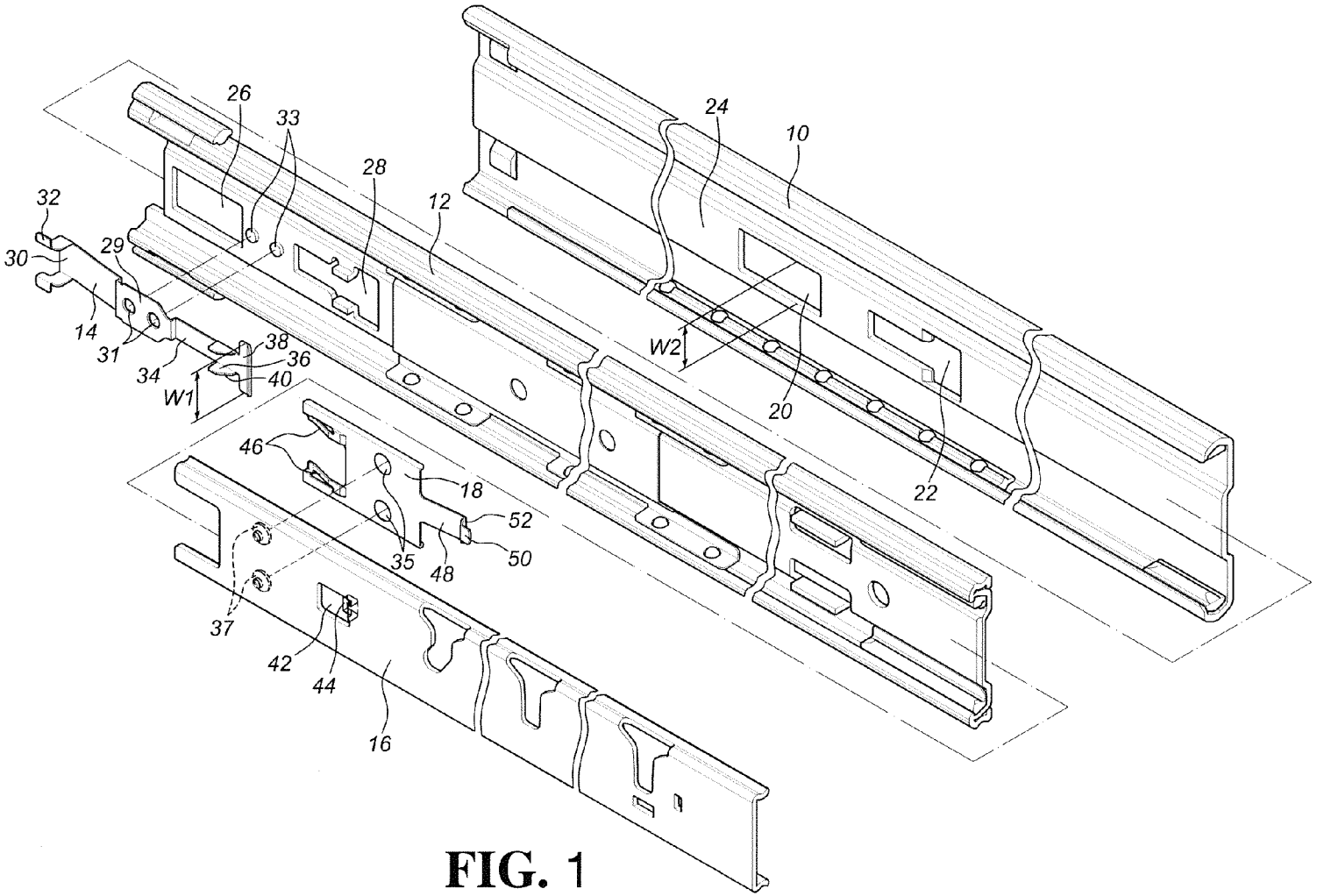
FIG. 1 is an exploded view to show the slide assembly of the present invention.
Figure 2:
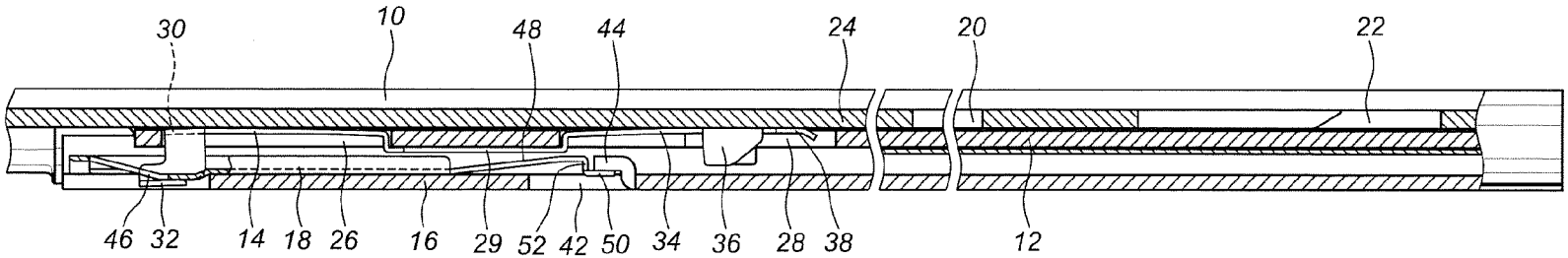
FIG. 2 shows that the inner rail is retracted relative to the outer rail of the present invention.

Referring to FIGS. 1 and 2, the slide assembly of the present invention comprises an outer rail 10, a middle rail 12, a locking member 14, an inner rail 16 and a releasing member 18.

Figure 4:
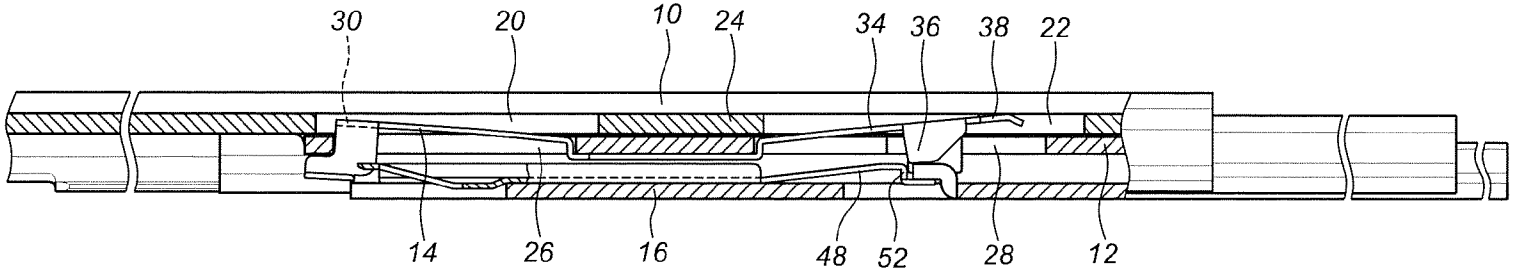
FIG. 4 shows that middle rail is located relative to the outer rail when the inner rail and the middle rail are pulled to a desired position.

The outer rail 10 comprises a locking hole 20, a releasing hole 22 and a protruding middle section 24 which faces the middle rail 12. The middle rail 12 is slidably connected to the outer rail 10 and has a first hole 26 and a second hole 28 defined therein. When the first hole 26 is located corresponding to the locking hole 20, the second hole 28 is located corresponding to the releasing hole 22 as shown in FIG. 4. A locking member 14 has a fixing portion 29 extending therefrom which is fixed to the middle rail 12.

The fixing portion 29 has two holes 31 and the middle rail 12 has two bosses 33 which are located corresponding to the holes 31. The bosses 33 are fixed to the holes 31 by a known way such as riveting to fix the locking member 14 to the middle rail 12.

The locking member 14 has a locking portion 30 and a releasing portion 32. The locking portion 30 extends through the first hole 26 of the middle rail 12 and resiliently contacts the middle section 24 of the outer rail 10. The releasing portion 32 is connected to the locking portion 30 and protrudes from the first hole 26 of the middle rail 12.

A synchronizing member 34 extends from the fixing portion 29 of the locking member 14 and extends through the second hole 28 of the middle rail 12 and resiliently contacts the middle section 24 of the outer rail 10. The synchronizing member 34 has a protrusion 36 and a contact portion 38. The protrusion 36 projects from the second hole 28 of the middle rail 12 and the contact portion 38 is located adjacent to the protrusion 36. The protrusion 36 has an inclined surface 40.

The inner rail 16 is slidably connected to the middle rail 16 and has a connection hole 42 which has a lug 44 extending therefrom.

The releasing member 18 is fixed to the inner rail 16 and has two holes 35. The inner rail 16 includes two bosses 37 which are fixed to the holes 35 by a known method such as riveting to fix the releasing member 18 to the inner rail 16. The releasing member 18 includes a guide surface 46 which is located corresponding to the releasing portion 32 of the locking member 14.

A connection member 48 extends from the releasing member 18 and has an end portion 50 and a shoulder portion 52. The end portion 50 is located corresponding to the connection hole 42 of the inner rail 16 and contacting the lug 44. The shoulder portion 52 extends from the end portion 50 and is located corresponding to the protrusion 36 of the synchronizing member 34.

Preferably, the width W1 of the contact portion 38 of the synchronizing member 34 is wider than the width W2 of the locking hole 20 of the outer rail 10.

By the arrangement, when the contact portion 38 of the synchronizing member 34 contacts the middle section 24 of the outer rail 10 and passes by the locking hole 20, the synchronizing member 34 does not sink into the locking hole 20 so that the synchronizing member 34 can pass by the locking hole 20.

Figure 8:
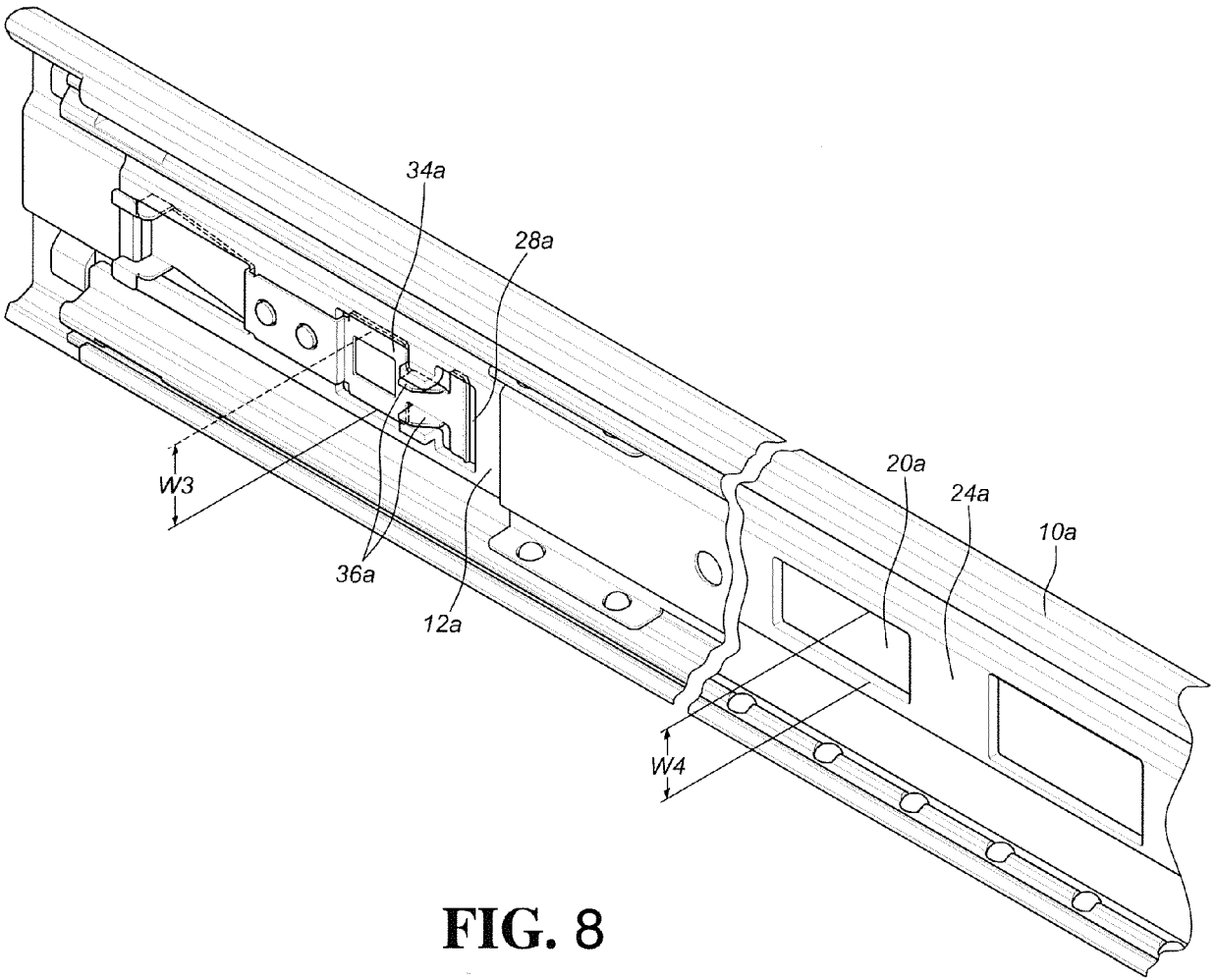
FIG. 8 shows the relative width of the synchronizing member and the locking hole of the outer rail.

As shown in FIG. 8 which shows a second embodiment, wherein the synchronizing member 34*a* has at least one protrusion 36*a* protruding from the second hole 28*a* of the middle rail 12*a*. Preferably, the width W3 of the synchronizing member 34*a* is wider than the width W4 of the locking hole 20*a* of the outer rail 10*a*. By the arrangement, when the synchronizing member 34*a* contacts the middle section 24*a* of the outer rail 10*a* and passes by the locking hole 20*a*, the synchronizing member 34*a* does not sink into the locking hole 20*a* so that the synchronizing member 34*a* can pass by the locking hole 20*a*.

Figure 3:
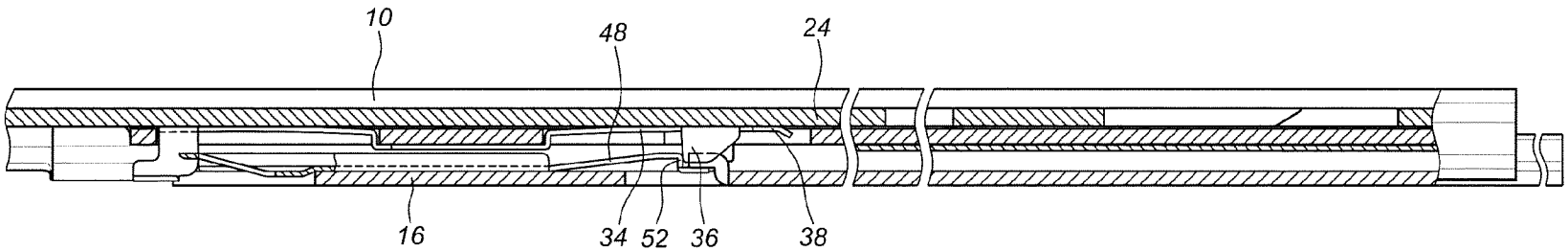
FIG. 3 shows that the inner rail begins to be pulled relative to the outer rail of the present invention.

As shown in FIG. 2, when the inner rail 16 is retracted relative to the middle rail 12, the contact portion 38 of the synchronizing member 34 contacts the middle section 24 of the outer rail 10, and the shoulder portion 52 of the connection member 48 is located corresponding to the protrusion 36 of the synchronizing member 34. Therefore, when the inner rail 16 begins to be pulled relative to the outer rail 10, as shown in FIG. 3, the shoulder portion 52 approaches to the protrusion 36 and engages with the protrusion 36, such that the inner rail 16 and the middle rail 12 are moved together.

As shown in FIG. 4, when the inner and middle rails 16 and 12 are co-moved, the middle rail 12 moves forward relative to the outer rail 10, the locking portion 30 of the locking member 14 is slidably moved on the middle section 24 of the outer rail 10 and the first hole 26 of the middle rail 12 is moved to be located corresponding to the locking hole 20 of the outer rail 10. The deformed locking portion 30 of the locking member 14 releases the resilient force and is inserted into the locking hole 20 of the outer rail 10, so that the middle rail 12 is locked relative to the outer rail 10. The middle rail 12 cannot be retracted backward.

Figure 5:
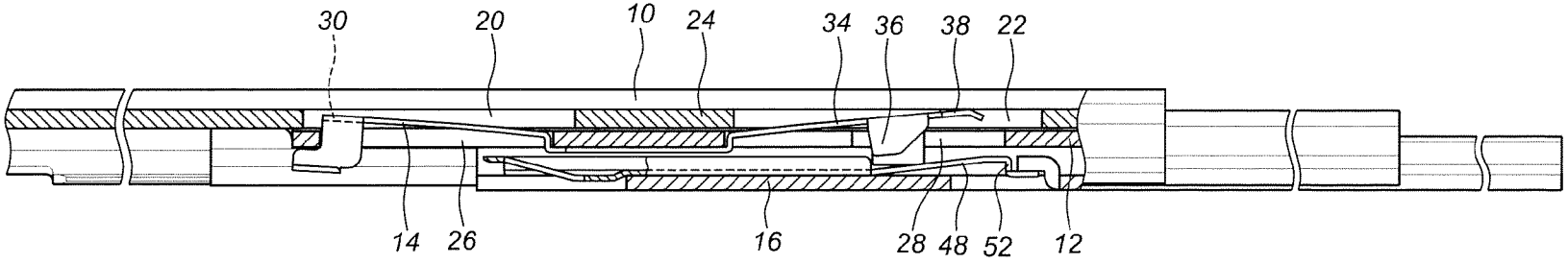
FIG. 5 shows that the inner rail is released from the middle rail and the inner rail is continuously pulled.

As shown in FIG. 4, when the first hole 26 of the middle rail 12 is located corresponding to the locking hole 20 of the outer rail 10 to lock the middle rail 12, the second hole 28 of the middle rail 12 is located corresponding to the releasing hole 22 of the outer rail 10. When the middle rail 12 is locked relative to the outer rail 10, the contact portion 38 of the synchronizing member 34 moves toward the opposite direction relative to the connection member 48. The contact portion 38 of the synchronizing member 34 sinks toward the releasing hole 22 of the outer rail 10 to retract the protrusion 36 from the second hole 28. The shoulder portion 52 of the connection member 48 is disengaged from the protrusion 36 of the synchronizing member 34. The inner rail 16 can be continuously pulled as shown in FIG. 5.

Figure 6:
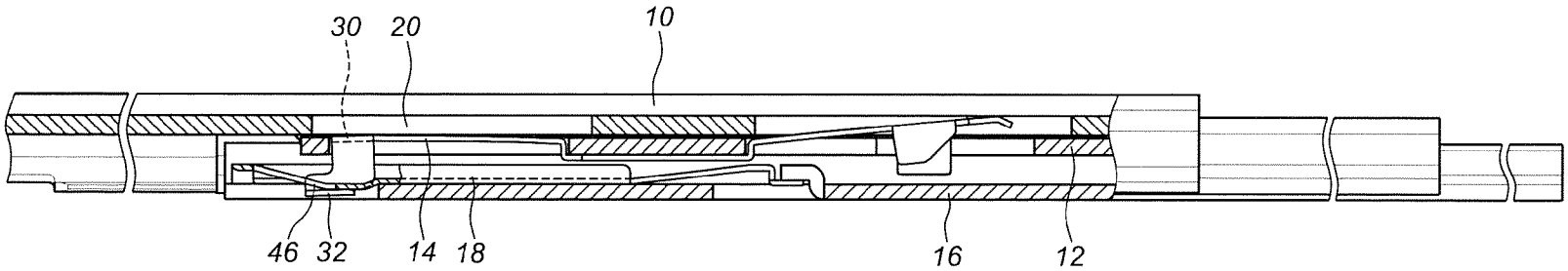
FIG. 6 shows that the inner rail is retracted relative to the outer rail so as to release the locked status of the middle rail.

Under the circumstance that the middle rail 12 is locked relative to the outer rail 10 and cannot be retracted, if the user wants to release the locked status, as shown in FIG. 6, when the inner rail 16 is retracted relative to the outer rail 10, the guide surface 46 of the releasing member 18 moves toward the releasing portion 32 of the locking member 14 so that the releasing portion 32 of the locking member 14 is supported by the guide surface 46 of the releasing member 18. The locking portion 30 of the locking member 14 is disengaged from the locking hole 20 of the outer rail 10, and the middle rail 12 is retracted relative to the outer rail 10 again.

Figure 7:
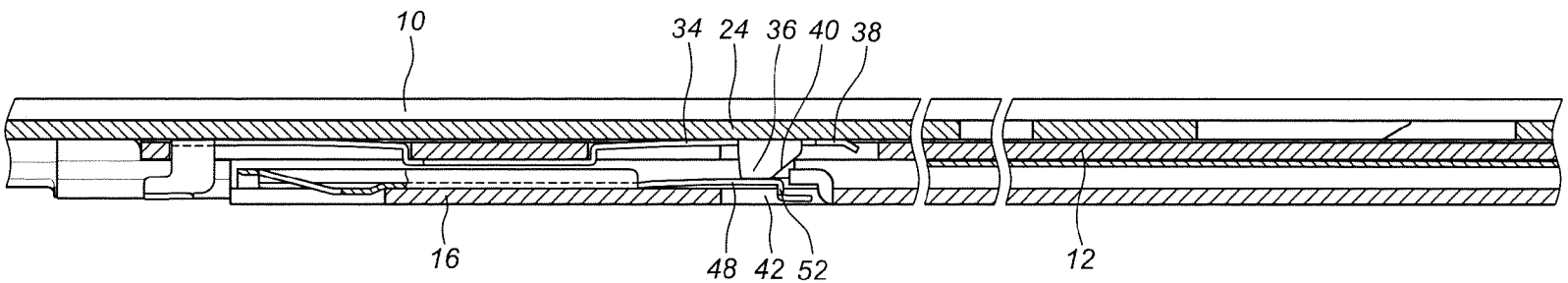
FIG. 7 shows the releasing action when the middle rail is first retracted.

As shown in FIG. 7, when the middle rail 12 is first retracted relative to the outer rail 10 and the inner rail 16 is then moved relative to the middle rail 12, the connection member 48 moves toward the synchronizing member 34. The contact portion 38 of the synchronizing member 34 contacts the middle section 24 of the outer rail 10 to secure the protrusion 36 which is not retracted. The connection member 48 contacts the inclined surface 40 of the protrusion 36 so that the connection member 48 is resiliently deformed and extends to the connection hole 42 of the inner rail 16. When the shoulder portion 52 of the connection member 48 moves over the inclined surface 40 of the protrusion 36, the connection member 48 releases a resilient force to engage the shoulder portion 52 of the connection member 48 with the protrusion 36 of the synchronizing member 34.

While we have shown and described the embodiment in accordance with the present invention, it should be clear to those skilled in the art that further embodiments may be made without departing from the scope of the present invention.

What is claimed is:

1. A slide assembly comprising:

an outer rail having a locking hole and a releasing hole;

a middle rail slidably connected to the outer rail and having a first hole and a second hole defined therein, when the first hole being located corresponding to the locking hole, the second hole being located corresponding to the releasing hole;

a locking member having a fixing portion extending therefrom which is fixed to the middle rail, the locking member having a locking portion and a releasing portion, the locking portion extending through the first hole of the middle rail and resiliently contacting the outer rail, the releasing portion connected to the locking portion and protruding from the first hole of the middle rail;

a synchronizing member extending from the fixing portion of the locking member and extending through the second hole of the middle rail and resiliently contacting the outer rail, the synchronizing member having a protrusion and a contact portion, the protrusion projecting from the second hole of the middle rail and the contact portion adjacent to the protrusion, the protrusion having an inclined surface;

an inner rail slidably connected to the middle rail and having a connection hole which has a lug extending therefrom;

a releasing member fixed to the inner rail and having a guide surface which is located corresponding to the releasing portion of the locking member;

a connection member extending from the releasing member and having an end portion and a shoulder portion, the end, portion located corresponding to the connection hole of the inner rail and contacting the lug, the shoulder portion extending from the end portion and located corresponding to the protrusion of the synchronizing member;

wherein when the middle rail slides relative to the outer rail, the locking portion of the locking member slidably contacts the outer rail and is moved in the first hole of the middle rail and to a position corresponding to the locking hole of the outer rail, the locking portion of the locking member is inserted into the locking hole of the outer rail, so that the middle rail is locked relative to the outer rail;

wherein when the inner rail is retracted relative to the middle rail, the releasing portion of the locking member is supported by the guide surface of the releasing member, so that the locking portion of the locking member is disengaged from the locking hole of the outer rail, and the middle rail is retracted relative to the outer rail;

wherein when the inner rail is pulled relative to the outer rail, the shoulder portion of the connection member is engaged with the protrusion of the synchronizing member, so that the middle rail is synchronously pulled with the inner rail, the contact portion of the synchronizing member sinks toward the releasing hole of the outer rail when the middle rail is locked relative to the outer rail, the protrusion is retracted from the second hole, the shoulder portion of the connection member is disengaged from the protrusion of the synchronizing member, so that the inner rail is continuously pulled, and wherein when the middle rail is first retracted relative to the outer rail and the inner rail is then moved relative to the middle rail, the connection member slidably contacts the inclined surface of the protrusion of the synchronizing member, the connection member is resiliently deformed and extends to the connection hole of the inner rail, when the shoulder portion of the connection member slidably contacts and moves over the inclined surface of the protrusion, the connection member releases resilient force to engage the shoulder portion with the protrusion of the synchronizing member.

2. The slide assembly as claimed in claim 1, wherein the outer rail has a middle section which extends toward the middle rail so that the locking portion of the locking member and the contact portion of the synchronizing member contact the middle section.

3. The slide assembly as claimed in claim 1, wherein a width of the contact portion of the synchronizing member is wider than a width of the locking hole of the outer rail.

4. The slide assembly as claimed in claim 1, wherein a width of the synchronizing member is wider than a width of the locking hole of the outer rail.

5. A connection device of a slide assembly, comprising:

a locking member having a fixing portion, a locking portion and a releasing portion, the releasing portion connected to the locking portion and protruding from the locking portion;

a releasing member having a guide surface located corresponding to the releasing portion of the locking member, the guide surface of the releasing member facing the releasing portion of the locking member and supporting the releasing portion of the locking member so as to deform the locking member and move the locking portion;

a synchronizing member having a protrusion and a contact portion which is located adjacent to the protrusion, the protrusion having an inclined surface; and a connection member having an end portion and a shoulder portion extending from the end portion, the shoulder portion located corresponding to the protrusion of the synchronizing member;

wherein when the shoulder portion of the connection member is engaged with the protrusion of the synchronizing member to synchronously move the synchronizing member, and the locking portion of the locking member is positioned, the contact portion of the synchronizing member moves in an opposite direction relative to the connection member so as to disengage the protrusion of the synchronizing member from the shoulder portion of the connection member;

wherein when the connection member is moved towards the synchronizing member, the connection member slidably contacts the inclined surface of the protrusion, the connection member is resiliently deformed when the shoulder portion of the connection member slidably contacts and moves over the inclined surface of the protrusion, the shoulder portion of the connection member is engaged with the protrusion of the synchronizing member.

6. The connection device as claimed in claim 5, wherein the synchronizing member extends from the fixing portion of the locking member.

7. The connection device as claimed in claim 5, wherein the connection member extends from the releasing member.

* * * * *